US006341451B1

(12) United States Patent
Morton, Sr.

(10) Patent No.: US 6,341,451 B1
(45) Date of Patent: Jan. 29, 2002

(54) PORTABLE GARAGE APPARATUS

(76) Inventor: Dudley Morton, Sr., 1715 Martin Luther King Jr. Dr., Atlanta, GA (US) 30314

( * ) Notice: Subject to any disclaimer, the term of this patent is extended or adjusted under 35 U.S.C. 154(b) by 0 days.

(21) Appl. No.: 09/636,600

(22) Filed: Aug. 11, 2000

(51) Int. Cl.[7] ..... E04H 6/00
(52) U.S. Cl. ..... 52/64; 52/66; 52/79.1
(58) Field of Search ..... 52/64, 66, 68, 52/69, DIG. 14, 79.1, 80.1, 173.3; 135/906

(56) References Cited

U.S. PATENT DOCUMENTS

| | | | | | |
|---|---|---|---|---|---|
| 3,600,866 | A | | 8/1971 | Griffith | |
| 4,074,269 | A | | 2/1978 | Hartley | |
| 4,416,085 | A | * | 11/1983 | Lybecker et al. | 49/340 |
| 4,800,701 | A | | 1/1989 | Dunsworth | |
| 4,944,321 | A | | 7/1990 | Moyet-Ortiz | |
| 4,984,399 | A | * | 1/1991 | Taylor | 52/64 |
| D362,729 | S | | 9/1995 | Kitchel | |
| 5,501,046 | A | * | 3/1996 | Hattingh et al. | 52/266 |
| 5,524,395 | A | * | 6/1996 | Boiron | 52/64 |
| 5,769,011 | A | * | 6/1998 | Daniel | 109/7 |
| 5,781,107 | A | | 7/1998 | Ji | |
| 5,936,550 | A | * | 8/1999 | McCauley | 340/936 |
| 6,029,404 | A | * | 2/2000 | Lewis | 52/2.18 |

* cited by examiner

*Primary Examiner*—Carl D. Friedman
*Assistant Examiner*—Jennifer I. Thissell

(57) ABSTRACT

A portable garage apparatus for providing shelter to a vehicle for people who don't have a garage. The portable garage apparatus includes a portable building structure having a floor, a top wall, side walls, an opening in a back end thereof, and an opening in a front end thereof; and also includes a plurality of doors securely attached to the building structure; and further includes a door opening and closing assembly; and also includes an alarm-sounding assembly for unauthorized entry into said portable building structure.

13 Claims, 3 Drawing Sheets

PORTABLE GARAGE APPARATUS

BACKGROUND OF THE INVENTION

1. Field of the Invention

The present invention relates to a vehicle protecting enclosure and more particularly pertains to a new portable garage apparatus for providing shelter to a vehicle for people who don't have a garage.

2. Description of the Prior Art

The use of a vehicle protecting enclosure is known in the prior art. More specifically, a vehicle protecting enclosure heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,944,321; 3,600,866; 4,074,269; 5,781,107; 4,800,701; and U.S. Pat. No. Des. 362,729.

While these devices fulfill their respective, particular objectives and requirements, the aforementioned patents do not disclose a new portable garage apparatus. The inventive device includes a portable building structure having a floor, a top wall, side walls, an opening in a back end thereof, and an opening in a front end thereof; and also includes a plurality of doors securely attached to the building structure; and further includes a door opening and closing assembly; and also includes an alarm-sounding assembly for unauthorized entry into said portable building structure.

In these respects, the portable garage apparatus according to the present invention substantially departs from the conventional concepts and designs of the prior art, and in so doing provides an apparatus primarily developed for the purpose of providing shelter to a vehicle for people who don't have a garage.

SUMMARY OF THE INVENTION

In view of the foregoing disadvantages inherent in the known types of vehicle protecting enclosure now present in the prior art, the present invention provides a new portable garage apparatus construction wherein the same can be utilized for providing shelter to a vehicle for people who don't have a garage.

The general purpose of the present invention, which will be described subsequently in greater detail, is to provide a new portable garage apparatus which has many of the advantages of the vehicle protecting enclosure mentioned heretofore and many novel features that result in a new portable garage apparatus which is not anticipated, rendered obvious, suggested, or even implied by any of the prior art vehicle protecting enclosure, either alone or in any combination thereof.

To attain this, the present invention generally comprises a portable building structure having a floor, a top wall, side walls, an opening in a back end thereof, and an opening in a front end thereof; and also includes a plurality of doors securely attached to the building structure; and further includes a door opening and closing assembly; and also includes an alarm-sounding assembly for unauthorized entry into said portable building structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable garage apparatus which has many of the advantages of the vehicle protecting enclosure mentioned heretofore and many novel features that result in a new portable garage apparatus which is not anticipated, rendered obvious, suggested, or even implied by any of the prior art vehicle protecting enclosure, either alone or in any combination thereof.

It is another object of the present invention to provide a new portable garage apparatus which may be easily and efficiently manufactured and marketed.

It is a further object of the present invention to provide a new portable garage apparatus which is of a durable and reliable construction.

An even further object of the present invention is to provide a new portable garage apparatus which is susceptible of a low cost of manufacture with regard to both materials and labor, and which accordingly is then susceptible of low prices of sale to the consuming public, thereby making such portable garage apparatus economically available to the buying public.

Still yet another object of the present invention is to provide a new portable garage apparatus which provides in the apparatuses and methods of the prior art some of the advantages thereof, while simultaneously overcoming some of the disadvantages normally associated therewith.

Still another object of the present invention is to provide a new portable garage apparatus for providing shelter to a vehicle for people who don't have a garage.

Yet another object of the present invention is to provide a new portable garage apparatus which includes a portable building structure having a floor, a top wall, side walls, an opening in a back end thereof, and an opening in a front end thereof; and also includes a plurality of doors securely attached to the building structure; and further includes a door opening and closing assembly; and also includes an alarm-sounding assembly for unauthorized entry into said portable building structure.

Still yet another object of the present invention is to provide a new portable garage apparatus that protects one's vehicle from the elements of the environment which could damage the vehicle in some manner.

Even still another object of the present invention is to provide a new portable garage apparatus that can be easily and conveniently set up any where desired by the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
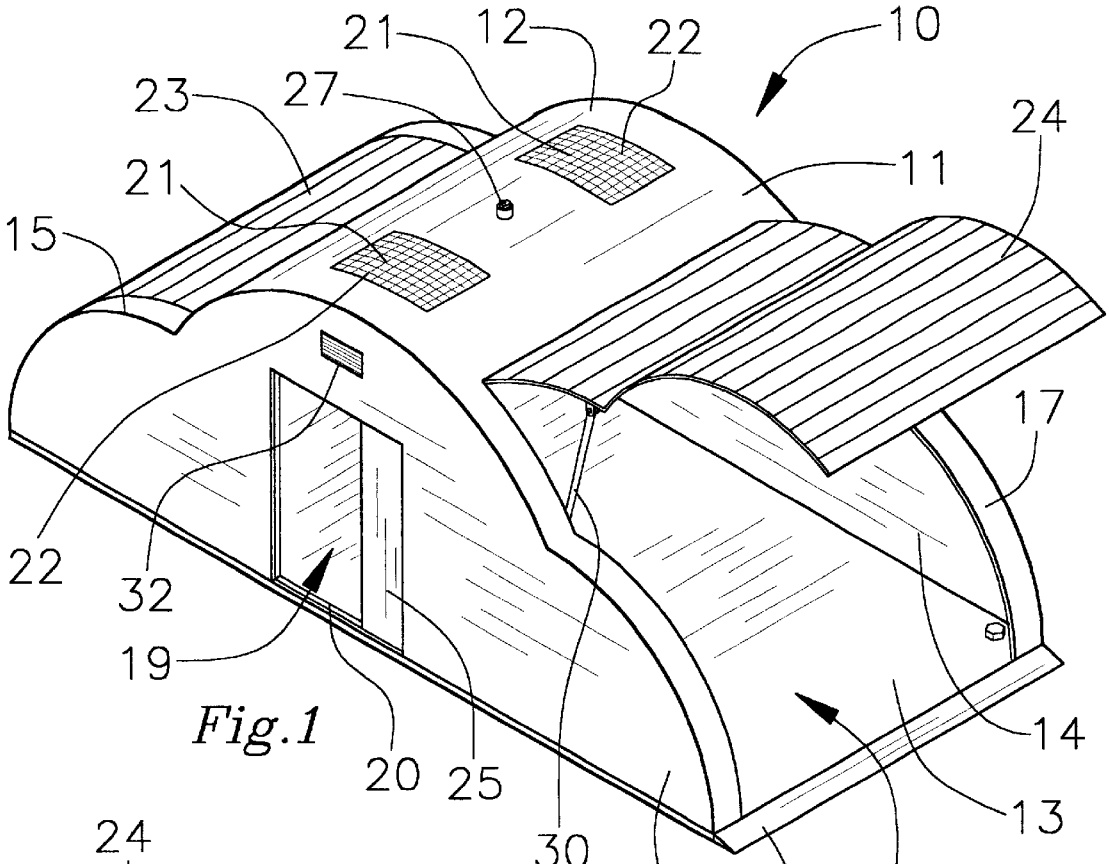
FIG. 1 is a perspective view of a new portable garage apparatus according to the present invention.
Figure 2:
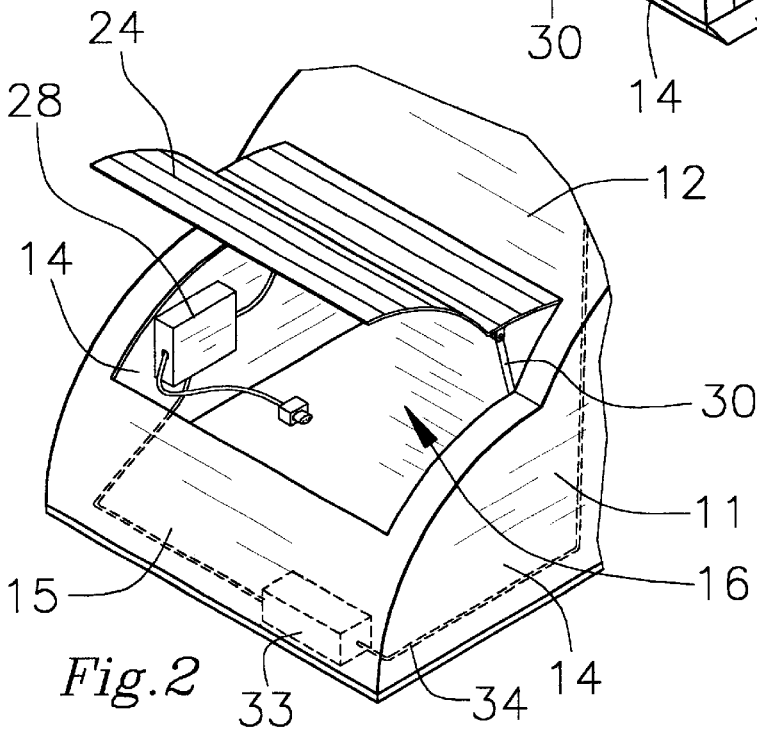
FIG. 2 is a front partial perspective view of the present invention.
Figure 3:
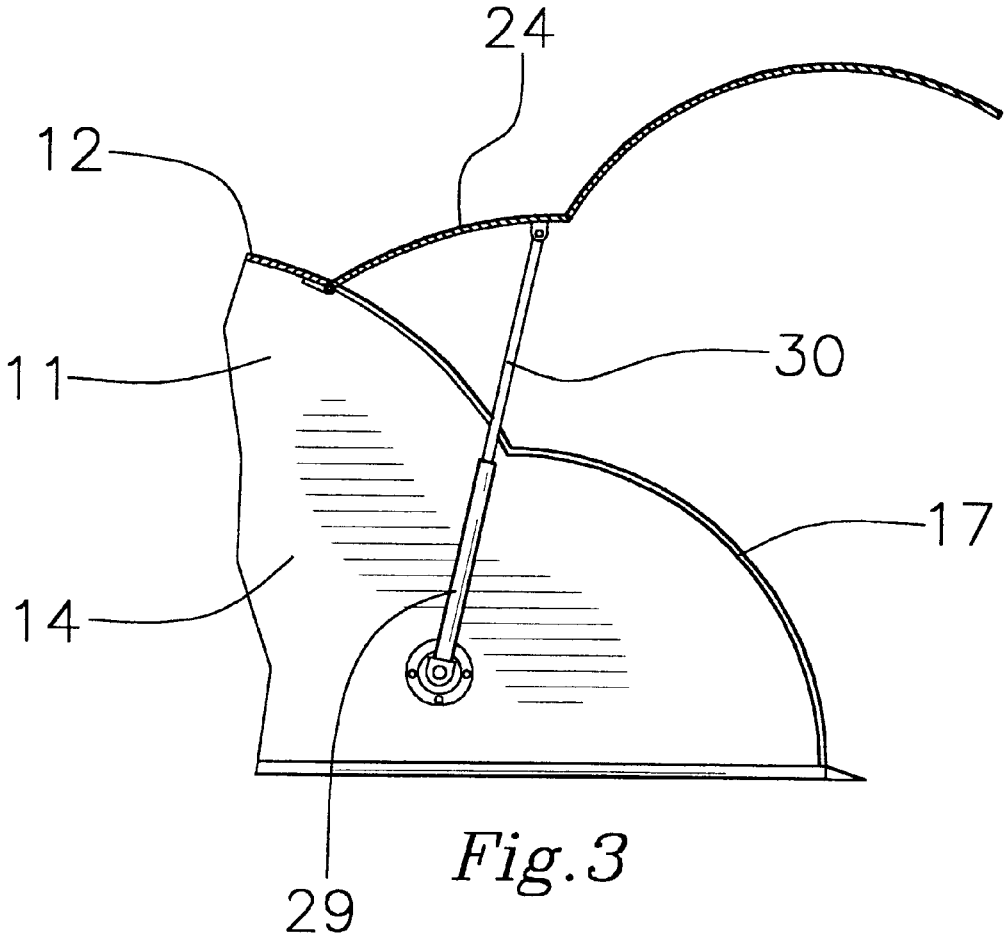
FIG. 3 is a rear side partial cross-sectional view of the present invention.
Figure 4:
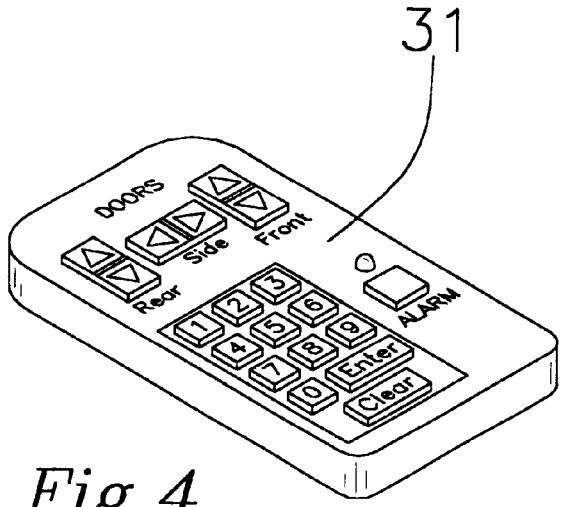
FIG. 4 is a perspective view of the remote radio transmitter of the present invention.
Figure 5:
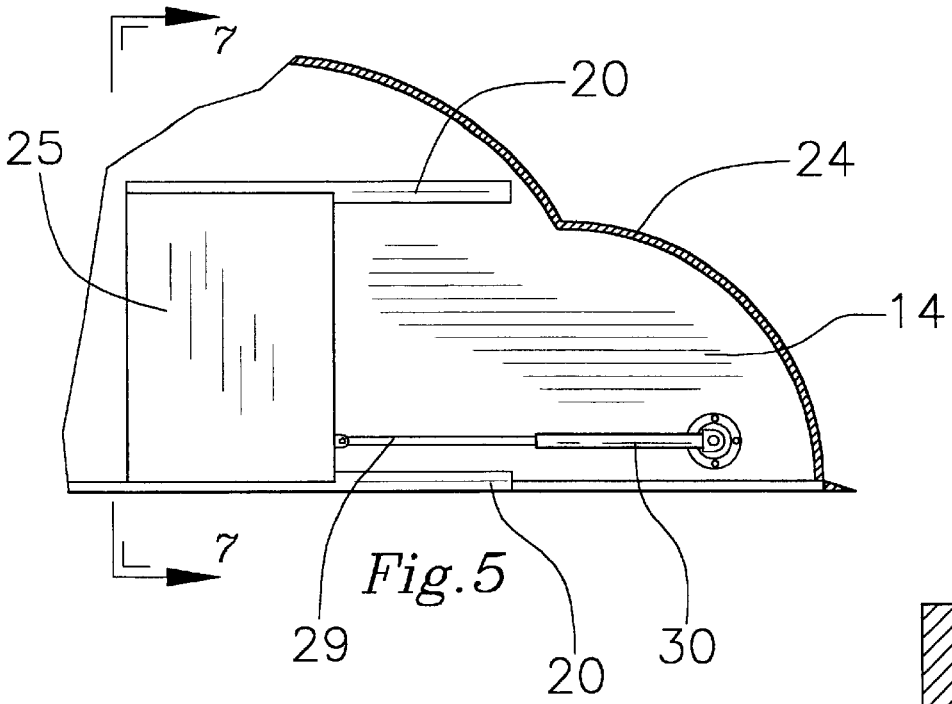
FIG. 5 is a rear side partial elevational view of the present invention.
Figure 6:
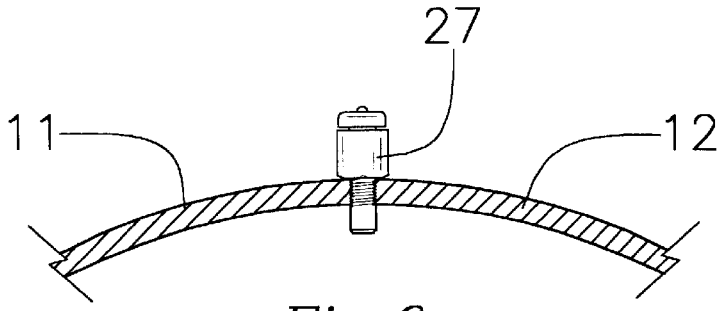
FIG. 6 is a top partial side elevational view of the present invention.
Figure 7:
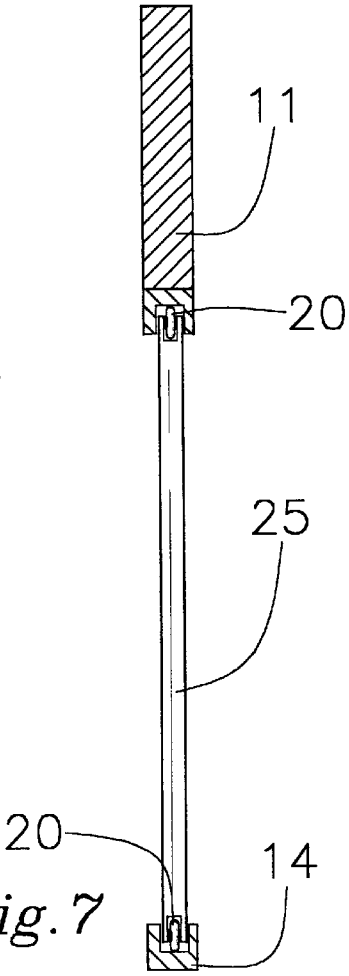
FIG. 7 is a cross-sectional view of the opening through the side wall of the building structure and side door of the present invention.

With reference now to the drawings, and in particular to FIGS. 1 through 7 thereof, a new portable garage apparatus embodying the principles and concepts of the present invention and generally designated by the reference numeral 10 will be described.

As best illustrated in FIGS. 1 through 7, the portable garage apparatus 10 generally comprises a portable building structure 11 having a floor 13, a top wall 12, side walls 14, an opening 18 in a back end 17 thereof, and an opening 16 in a front end 15 thereof. The building structure 11 includes air vents 32 extending through the side walls 14 and also includes mesh-like members 22 conventionally covering the air vents 32 for allowing outside air to enter the building structure 11. The building structure 11 also includes a ramp 26 securely and conventionally attached to an end of the floor 13 at the back end 17 thereof and being adapted to allow a vehicle to enter the building structure 11 through the opening 18 in the back end 17. The building structure 11 further includes an opening 19 extending through one of the side walls 14 thereof and also includes a lower track 20 being securely and conventionally disposed upon a portion of the floor 13 along a side edge thereof including where the opening 19 in the side wall 14 is located and includes an upper track 20 securely disposed upon the side wall 14 and extending along a top edge of the opening 19 in the side wall 14. Each of the front 15 and back 17 ends has an upper portion and a lower portion with each of the upper and lower portions being curved and bowed relative to one another to essentially be shaped like that of the front and back end of the vehicle.

A plurality of doors 23–25 are securely and conventionally attached to the building structure 11, and include a front door 23 which has an end hingedly attached to the top wall 12 and being closeable over the opening 16 in the front end 15 of the building structure 11, and also include a back door 24 having an end which is hingedly attached to the top wall 12 and being closeable over the opening 18 in the back end 17 of the building structure 11, and further include a side door 25 which is slidably disposed upon the tracks 20 and which is closeable over the opening 19 in the side wall 14. Each of the front 23 and back 24 doors has a first end portion and a second end portion with each of the end portions being curved and bowed relative to one another to essentially be shaped like that of a front and back end of a vehicle.

A means for opening and closing the doors 23–25 includes solar energy panels 21,22 disposed in said top wall 12 of the building structure 11 and connected to wires 34, and also includes a solar battery 33 securely stored in the building structure 11 and being connected to the wires 34, and further includes cylinder members 29 each being securely and pivotally attached to an inner side of one of the side walls 14 adjacent to a respective one of the doors 23–25, and also includes arm members 30 each being extendably and retractably disposed in a respective cylinder member 29 through an open end thereof and being securely attached to a respective door 23–25, and further includes a control unit 28 securely and conventionally disposed inside the building structure 11 and being connected to the cylinder 29 and arm 30 members for extending and retracting the arm members 30 and also being adapted to be connected to a power source which is the solar battery 33, and also includes a remote radio transmitter 31 for energizing the control unit 28 to open and close the doors 23–25.

An alarm-sounding means for unauthorized entry into the portable building structure 11 includes a blinking light-emitting and alarm-sounding member 27 being securely and conventionally disposed in the top wall 12 and extending upwardly therefrom and also including the control unit 28 which is connected to the doors 23–25 and to the light-emitting and alarm-sounding member 27, and further includes the remote radio transmitter 31 for energizing the control unit 28 to set the light-emitting and alarm-sounding member 27 which is energized upon any one of the doors 23–25 being opened.

In use, the portable building structure 11 can be positioned anywhere desired by the user usually where there is not a garage on site. To enter the building structure 11, the user would use the remote radio transmitter 31 to open the back door 24 and then also use the remote radio transmitter 31 to close the back door 24. The user can exit the building structure 11 through the side door 25 by using the remote radio transmitter 31. To protect the vehicle, the user can activate the light-emitting and alarm-sounding member 27 by using the remote radio transmitter 31.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable garage apparatus comprising:

a portable building structure having a floor, a top wall, side walls, an opening in a back end thereof, and an opening in a front end thereof;

a plurality of doors securely attached to said building structure;

a means for opening and closing said doors; and an alarm-sounding means for unauthorized entry into said portable building structure;

wherein said building structure includes air vents extending through said side walls and also includes mesh members covering said air vents for allowing outside air to enter said building structure;

wherein said building structure includes a ramp securely attached to an end of said floor at said back end thereof and being adapted to allow a vehicle to enter said building structure through said opening in said back end;

wherein said building structure includes an opening extending through one of said side walls thereof and also includes a lower track being securely disposed upon a portion of said floor along a side edge thereof including where said opening is located and further includes an upper track securely disposed upon the side wall and extending along a top edge of the opening in the side wall;

wherein said doors include a front door which has an end hingedly attached to said top wall and being closeable over said opening in said front end of said building structure, and also include a back door having an end which is hingedly attached to said top wall and being closeable over said opening in said back end of said building structure, and further includes a side door which is slidably disposed upon said track and which is closeable over said opening in said side wall; and wherein said means for opening and closing said doors includes solar energy panels disposed in said top wall of said building structure and connected to wires, and also includes a solar battery securely stored in said building structure and being connected to said wires, and further includes cylinder members each being securely and pivotally attached to an inner side of one of said side walls adjacent to a respective one of said doors, and also includes arm members each being extendably and retractably disposed in a respective said cylinder member through an open end thereof and being securely attached to a respective said door, and further includes a control unit securely disposed inside said building structure and being connected to said cylinder and said arm members for extending and retracting said arm members and also being adapted to be connected to a power source which is said solar battery, and also includes a remote radio transmitter for energizing said control unit to open and close said doors.

2. A portable garage apparatus as described in claim 1, wherein said alarm-sounding means includes a blinking light-emitting and alarm-sounding member securely disposed in said top wall and extending upwardly therefrom and also includes said control unit which is connected to said doors and to said light-emitting and alarm-sounding member, and further includes said remote radio transmitter for activating said light-emitting and alarm-sounding member which is energized upon any one of said doors being opened.

3. A portable garage door apparatus as described in claim 1, wherein each of said front and back doors has a first end portion and a second end portion, each of said end portions being curved and bowed relative to one another to essentially be shaped like that of a front and back end of a vehicle.

4. A portable garage door apparatus as described in claim 1, wherein each of said front and back ends has an upper portion and a lower portion, each of said upper and lower portions being curved and bowed relative to one another to essentially be shaped like that of the front and back end of the vehicle.

5. A portable garage apparatus comprising:

a portable building structure having a floor, a top wall, side walls, an opening in a back end thereof, and an opening in a front end thereof, said building structure including air vents extending through said side walls and also including mesh members covering said air vents for allowing outside air to enter said building structure, said building structure including a ramp securely attached to an end of said floor at said back end thereof and being adapted to allow a vehicle to enter said building structure through said opening in said back end, said building structure including an opening extending through one of said side walls thereof and also including a lower track being securely disposed upon a portion of said floor along a side edge thereof including where said opening is located and including an upper track securely disposed upon the side wall and extending along a top edge of the opening in the side wall, each of said front and back ends having an upper portion and a lower portion, each of said upper and lower portions being curved and bowed relative to one another to essentially be shaped like that of the front and back end of the vehicle;

a plurality of doors securely attached to said building structure, said doors including a front door which has an end hingedly attached to said top wall and being closeable over said opening in said front end of said building structure, and also including a back door having an end which is hingedly attached to said top wall and being closeable over said opening in said back end of said building structure, and further including a side door which is slidably disposed upon said track and which is closeable over said opening in said side wall, each of said front and back doors having a first end portion and a second end portion, each of said end portions being curved and bowed relative to one another to essentially be shaped like that of a front and back end of a vehicle;

a means for opening and closing said doors including solar energy panels disposed in said top wall of said building structure and connected to wires, and also including a solar battery securely stored in said building structure and being connected to said wires, and further including cylinder members each being securely and pivotally attached to an inner side of one of said side walls adjacent to a respective one of said doors, and also including arm members each being extendably and retractably disposed in a respective said cylinder member through an open end thereof and being securely attached to a respective said door, and further including a control unit securely disposed inside said building structure and being connected to said cylinder and arm members for extending and retracting said arm members and also being adapted to be connected to a power source which is said solar battery, and also including a remote radio transmitter for energizing said control unit to open and close said doors; and an alarm-sounding means for unauthorized entry into said portable building structure including a blinking light-emitting and alarm-sounding member being securely disposed in said top wall and extending upwardly therefrom and also including said control unit which is connected to said doors and to said light-emitting and alarm-sounding member, and further including said remote radio transmitter for energizing said control unit to activate said light-emitting and alarm-sounding member which is energized upon any one of said doors being opened.

6. A portable garage apparatus comprising:

a portable building structure having a floor, a top wall, side walls, an opening in a back end thereof, and an opening in a front end thereof;

a plurality of doors securely attached to said building structure;

a means for opening and closing said doors; and an alarm-sounding means for unauthorized entry into said portable building structure;

wherein said means for opening and closing said doors comprises:

solar energy panels mounted on said top wall of said building structure;

extendable and retractable assemblies each being pivotally attached to and extending between one of said side walls adjacent to a respective one of said doors and a respective said door;

a control unit connected to said extendable and retractable assemblies for actuating said assemblies; and a remote radio transmitter for causing said control unit to open and close said doors.

7. A portable garage apparatus as described in claim 6, wherein said building structure includes air vents extending through said side walls and also includes mesh members covering said air vents for allowing outside air to enter said building structure.

8. A portable garage apparatus as described in claim 6, wherein said building structure includes a ramp attached to an end of said floor at said back end thereof and being adapted to allow a vehicle to enter said building structure through said opening in said back end.

9. A portable garage apparatus as described in claim 6, wherein said building structure includes an opening extending through one of said side walls thereof and also includes a lower track being disposed upon a portion of said floor and an upper track disposed upon the side wall and extending along a top edge of the opening in the side wall.

10. A portable garage apparatus as described in claim 6, wherein said doors include a front door pivotally attached to said top wall and being closeable over said opening in said front end of said building structure, and also include a back door pivotally attached to said top wall and being closeable over said opening in said back end of said building structure, and a side door which is slidably mounted upon said track and which is closeable over said opening in said side wall.

11. A portable garage apparatus as described in claim 6, wherein said alarm-sounding means includes a light-emitting and alarm-sounding member connected to said control unit, and wherein said remote radio transmitter activates said light-emitting and alarm-sounding member when any one of said doors being opened.

12. A portable garage door apparatus as described in claim 6, wherein each of said front and back doors has a first end portion and a second end portion, each of said end portions being curved and bowed relative to one another.

13. A portable garage door apparatus as described in claim 6, wherein each of said front and back ends has an upper portion and a lower portion, each of said upper and lower portions being curved and bowed relative to one another.

* * * * *